US006546778B2

(12) United States Patent
Jordan

(10) Patent No.: US 6,546,778 B2
(45) Date of Patent: Apr. 15, 2003

(54) TOOL FOR REMOVING DAMAGED FASTENERS AND METHOD FOR MAKING SUCH TOOL

(76) Inventor: Chalmer C. Jordan, R.D. 1, Box 575, Saegertown, PA (US) 16433

( * ) Notice: Subject to any disclaimer, the term of this patent is extended or adjusted under 35 U.S.C. 154(b) by 0 days.

(21) Appl. No.: 10/007,233

(22) Filed: Nov. 5, 2001

(65) Prior Publication Data

US 2002/0040625 A1 Apr. 11, 2002

Related U.S. Application Data

(62) Division of application No. 09/439,211, filed on Nov. 12, 1999, now Pat. No. 6,339,976.

(51) Int. Cl.[7] ..... B21K 5/16
(52) U.S. Cl. ..... 72/356; 72/343
(58) Field of Search ..... 73/343, 354.6, 73/355.4, 356

(56) References Cited

U.S. PATENT DOCUMENTS

| | | | |
|---|---|---|---|
| 1,430,004 | A | 9/1922 | Carlson |
| 1,590,200 | A | 6/1926 | McGuckin |
| 2,027,922 | A | 1/1936 | McNaught |
| 3,996,819 | A | 12/1976 | King |
| 4,126,063 | A | 11/1978 | Palmer |
| 4,217,771 | A | 8/1980 | Braun |
| 4,271,240 | A | 6/1981 | Braun |
| 4,291,568 | A | 9/1981 | Stifano, Jr. |
| 4,322,256 | A | 3/1982 | Henning |
| 4,328,720 | A | 5/1982 | Shiel |
| 4,452,060 | A | 6/1984 | Kanamaru et al. |
| 4,671,141 | A | 6/1987 | Hanson |
| 4,993,289 | A | 2/1991 | Parks |
| 5,012,706 | A | 5/1991 | Wright et al. |
| 5,052,210 | A | 10/1991 | Hoge |
| 5,074,174 | A | 12/1991 | Kim |
| 5,551,320 | A | 9/1996 | Horobec et al. |
| 5,782,148 | A | 7/1998 | Kerkhoven |
| 6,003,411 | A | 12/1999 | Knox et al. |
| 6,047,620 | A | 4/2000 | Kozak et al. |

*Primary Examiner*—Lowell A. Larson
(74) *Attorney, Agent, or Firm*—Cohen & Grigsby P.C.

(57) ABSTRACT

A tool for removing damaged fasteners and a method for making such tool wherein the tool (10) includes a first end (12) and a second end (14) with an outside surface (32) and an inside surface (40) defined between ends (12) and (14). A portion (46) of inside surface (40) is in the shape of an hexagonal frustum (54) that has a major end (58) and that includes spiral splines (25). Splines (25) have constant depth between the major end (58) and the minor end (56) of frustum (54) and the relief angle (£) of splines (25) decreases in the direction from minor end (56) toward major end (58). In the method for making the tool (10), a tubular section (118) is made from a tapered blank (91) by piercing one end of the tapered blank with a pierce punch (132). One end of the tubular section is then driven onto a splined punch (162) to provide splines in one end of the tubular section. The tubular section is then stripped off of the punch (162) by a kick-out sleeve (166) and extruded through a round-to-hexagonal extrusion insert (182) to provide portion (46) of the inner surface (40) with a tapered, hexagonal shape.

11 Claims, 8 Drawing Sheets

TOOL FOR REMOVING DAMAGED FASTENERS AND METHOD FOR MAKING SUCH TOOL

CROSS REFERENCE TO RELATED APPLICATION

This application is a divisional of U.S. application Ser. No. 09/439,211 filed Nov. 12, 1999 entitled "IMPROVED TOOL FOR REMOVING DAMAGED FASTENERS AND METHOD FOR MAKING SUCH TOOL" now U.S. Pat. No. 6,339,976.

BACKGROUND OF THE INVENTION

1. Field of the Invention

The presently disclosed invention relates to tools for removing threaded fasteners and, more particularly, fasteners wherein the perimeter surface of the fastener has been damaged by corrosion or mechanical stress such that the corners of the polygonal surface have become rounded.

2. Description of the Prior Art

Many types of threaded fasteners are known in the prior art. Such fasteners have various designs for cooperation of the fastener with a threaded member. Some of these fasteners, such as wing nuts or thumb screws, are intended to be applied and removed without the use of tools. Other fasteners, such a threaded nuts, require the use of tools for their application and removal.

In particular, many types of fasteners have an inner threaded surface and an outer polygonal surface, typically a hexagonal surface. The inner threaded surface cooperates with the threaded member and the outer surface cooperates with a tool that is used to apply or remove the fastener from the threaded member. Various types of tools have been developed and used for this purpose. Examples are shown and described in U.S. Pat. Nos. 4,328,720; 4,671,141; and 4,993,289. Basically, these tools cooperate with the polygonal sides of the fastener to transfer a torque force that is required to turn the fastener on and off of the bolt or other threaded member.

There has been a persistent problem with the polygonal-style threaded fasteners in the prior art when the polygonal sides become worn or damaged the sides no longer define the requisite shape that is necessary for the fastener to cooperate with the tool that is designed for its application and removal. Frequently this problem arises when the fastener is to be removed and the polygonal sides have been damaged due to corrosion or mechanical wear. In this situation, the conventional tools that are designed for the removal of the fastener are no longer operative. Generally, the conventional tool will merely slip over the rounded or damaged corners between the polygonal sides of the fastener so that the tool will not remove the fastener.

This difficulty has been recognized in the prior art wherein different types of tools have been developed for the removal of damaged polygonal fasteners from their threaded members. Examples of such tools are shown and described in U.S. Pat. Nos. 3,996,819 and 5,551,320. U.S. Pat. No. 3,996,819 is directed to a wrench socket wherein a number of raised teeth are arranged in a conical-shaped opening in the tool. The teeth are aligned angularly within the conical opening. As the tool is turned to remove the fastener, the teeth engage the fastener and cause the tool to transfer torque to the fastener so that it can be removed. U.S. Pat. No. 5,551,320 is directed to an improved tool for removing damaged fasteners. In this tool, a plurality of teeth also engage the fastener for the purpose of removing the damaged fastener from the threaded member.

One difficulty with the tools for removing damaged fasteners as known in the prior art was that the tools could not be readily manufactured in accordance with conventional manufacturing processes. Machining the individual teeth into a tool body such as described in U.S. Pat. Nos. 3,996,819 and 5,551,320 was not practical on a commercial scale. Broaching the teeth into the tool body was also found to be unworkable because the geometry of the tool caused the broach to seize in the tool. This resulted in the destruction of either the broach or the tool, or both.

Accordingly, there was a need in the prior art for a commercial manufacturing method that could be practiced to manufacture tools for removing damaged threaded fasteners.

SUMMARY OF THE INVENTION

In accordance with the invention, a cold metal forming process for making a tool to remove damaged fasteners is disclosed herein. According to the process, the tool is cold formed from a tubular section that has a cylindrical inside surface and a tapered outside surface. In the cold forming process, the tubular section is driven onto a floating punch that has helical splines at the working end of the punch. The floating punch has a substantially constant radius and is secured in the longitudinal dimension with respect to the die plate, but is freely rotatable in the angular direction. As the tubular section is driven onto the punch, the punch angularly rotates in response to the longitudinal movement of the tubular section and in accordance with the pitch of the helical splines. The tubular section rotates in a first direction in accordance with the direction of the splines on the punch to form helical splines at one end of the inside surface of the tubular section.

After the splines are formed in the inside surface of the tubular section, the tubular section is stripped off of the end of the floating punch. As the tubular section is stripped off the end of the floating punch, the punch angularly rotates in the direction that is opposite from the first angular direction. In this way, the tubular section is removed from the floating punch while preserving the helical splines on the inner surface of the tubular section.

After the tubular section is stripped off of the floating punch, it is extruded through a round-to-polygonal extrusion die insert. This step cold forms the tapered outer surface of the tubular section to a polygonal surface that has a constant cross-section. The same step also cold forms the inside surface of the tubular section from a cylindrical inner surface to a surface that is tapered and polygonal at the one end of the tubular section having the internal splines. The direction of the taper of the inner surface provides the largest cross-section at the end of the tubular section that was driven onto the floating punch.

Also preferably, the step of driving the floating punch into one end of the tubular section includes the steps of positioning the tubular insert in a die that is slidably located in a die sleeve. One end of the tubular section is then contacted to move the tubular section toward the floating punch and then drive a portion of the tubular section over the splined end of the floating punch. A cylindrical kickout sleeve that is concentrically located around the floating punch and is longitudinally slidable with respect to the. floating punch is then extended to contact the end of the tubular section and strip the tubular section off of the floating punch.

More preferably, it has been found that the tool made in accordance with the disclosed method includes a first end and a second end that is oppositely disposed on the tool body from the first end. The tool has an outside surface that is defined between the first and the second ends. In addition, the tool has an inside surface that defines a closed passageway between the first and second ends. A portion of the inside surface that is adjacent to the second end is a polygonal surface that defines a central opening with the area of the central opening decreasing as the longitudinal position away from the second end increases. The portion of the inside surface that is adjacent to the second end also includes a plurality of spiral splines that extend radially inward.

Also preferably, the sides of the polygonal internal surface of the tool are joined by corners and the polygonal sides have midpoints that are located midway between the respective corners. At the second end of the tool, the radial inward extent of the splines is increases as the angular location of the spline is closer to the angular location of the midpoint of the polygonal side on which the spline is located.

Most preferably, the spline is defined by roots on opposite side of a crest. The depth of the spline is the difference between the radial position of the root and the radial position of the crest, the depth of the spline being substantially constant. Also, at a given longitudinal position along the splines, the crest of the spline cooperates with each of the roots to define adjoining sides of the spline. The bisector of the internally included angle between the sides defines the relief angle of the spline at a given longitudinal position, the relief angle of the spline decreasingly in the longitudinal direction away from the second end of the tool.

Other features, objects and advantages of the disclosed invention will become apparent to those skilled in the art as a presently preferred embodiment of the disclosed tool and a presently preferred method of making the same proceeds.

BRIEF DESCRIPTION OF THE DRAWINGS

The presently disclosed invention is shown and described in connection with the accompanying drawings wherein.

DESCRIPTION OF THE PREFERRED EMBODIMENT

Figure 1:
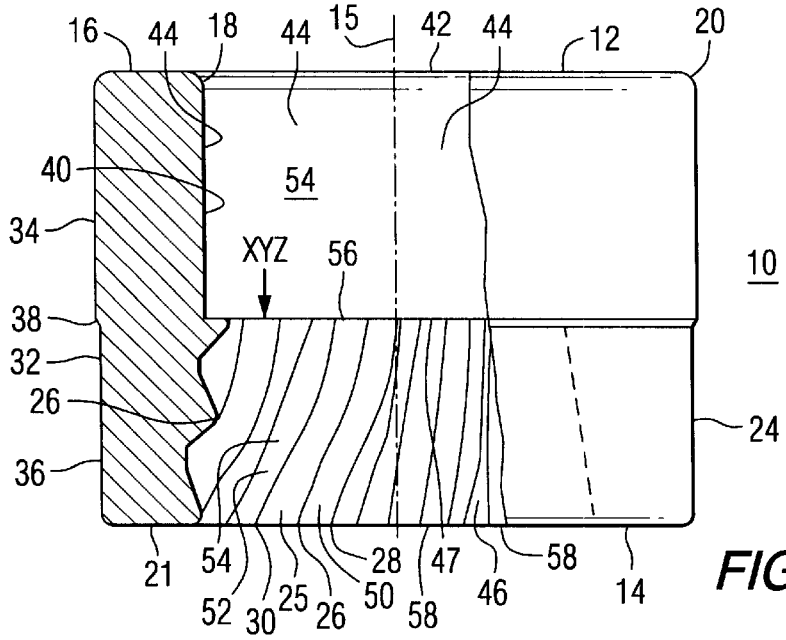
FIG. 1 represents a tool in accordance with the disclosed invention with portions thereof broken away to better disclose details thereof.
Figure 2:
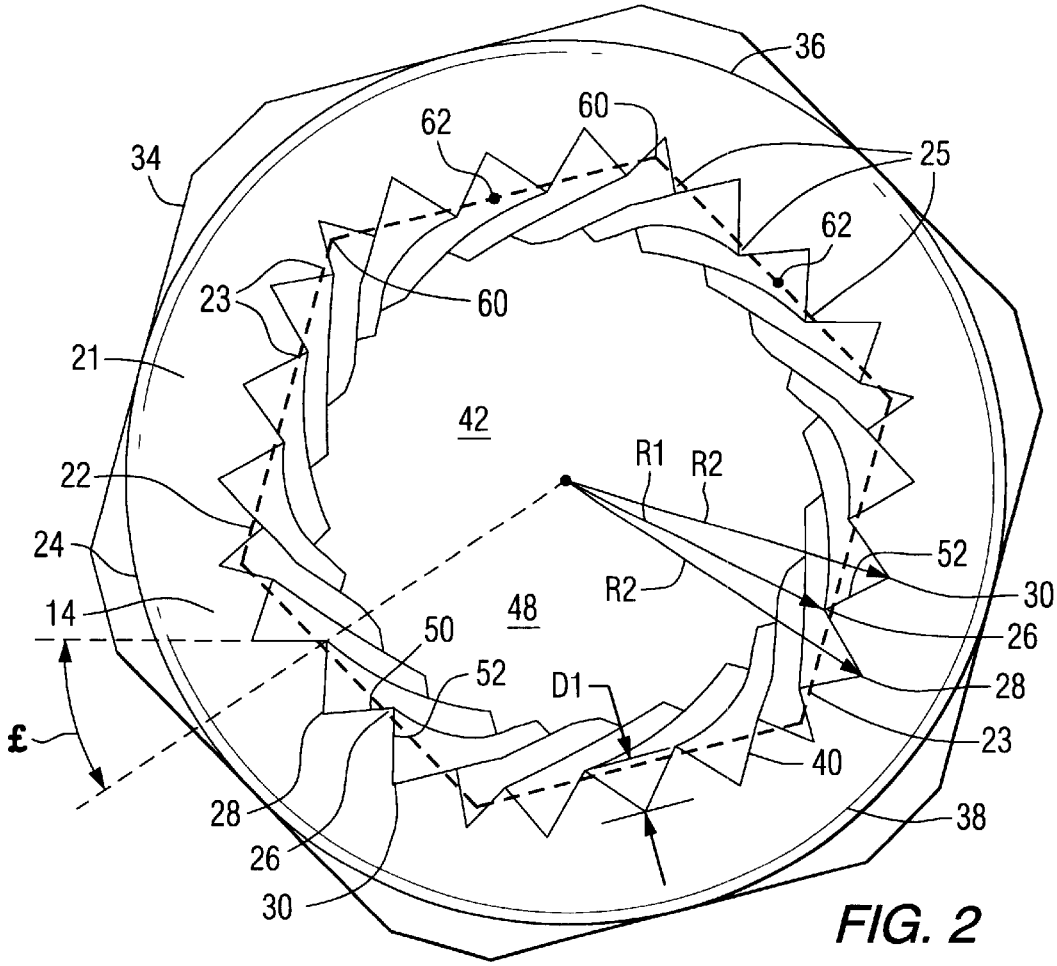
FIG. 2 is a top view of the tool shown in FIG. 1.

As shown in FIGS. 1 and 2, the presently disclosed tool 10 is used for the removal of nuts and other threaded fasteners from their corresponding bolts or equivalent threaded members. In particular, tool 10 is useful in the removal of threaded fasteners that have been damaged or corroded such that the outer surface of the fastener has been damaged and the fastener cannot be readily removed by wrenches, sockets or other tools that are designed for the removal of fasteners that are in good condition.

Tool 10 includes a first end 12 and a second end 14 that are aligned on a longitudinal center axis 15. First end 12 is in the general shape of a planar ring 16 that has a square inner edge 18 and a hexagonal outer edge 20. Second end 14 is in the general shape of a planar ring 21 that has a generally hexagonal inner edge 22 that includes hexagonal sides 23. Second end 14 further includes a circular outer edge 24. While inner edge 22 is hexagonal in the example of the preferred embodiment, is will be apparent to those skilled in the art that other polygonal shapes are also within the scope of the disclosed invention.

Hexagonal inner edge 22 includes a plurality of splines 25 that are directed radially inwardly towards the longitudinal center axis 15 of tool 10. Each of splines 25 are defined by a respective crest 26 that is located at a first radial position from the longitudinal center axis 15 and two roots 28, 30 that are angularly located on opposite sides of crest 26. The radial position R2 of each of said roots 28, 30 from the longitudinal center axis 15 is greater than the radial position of R1 the crest 26.

First end 12 and second end 14 are oppositely disposed on the body of tool 10. An outside surface 32 is defined between first end 12 and second end 14. A portion 34 of outside surface 32 that is adjacent to first end 12 defines a hexagonal surface. That is, in portion 34 the cross-section that is orthogonal to the longitudinal center axis 15 has a. hexagonal outside surface 32. A portion 36 of outside surface 32 that is adjacent to second end 14 defines a circular surface that is in portion 36 the cross-section of the body that is orthogonal to the longitudinal center axis 15 has a circular outside surface 32. Outside portion 34 and outside portion 36 are joined at a boundary 38.

An inside surface 40 between first end 12 and second end 14 defines a closed passageway 42 between the first and second ends. A portion 44 of inside surface 40 that is adjacent to the first end 12 defines a square recess that is adapted to receive the drive pin of a ratchet or other lever (not shown). A portion 46 of inside surface 40 that is adjacent to second end defines a hexagonal surface. A transition boundary 47 is established between portions 44 and 46. More specifically, portion 46 of inside surface 40 defines a central opening 48 wherein the cross-sectional area of the central opening taken orthogonally to longitudinal center axis 15 decreases as the longitudinal spacing from second end 14 increases. Accordingly, portion 46 of inside surface 40 defines a hexagonal frustum 54 having a minor end 56 that is located at the transition boundary 47 and a major end 58 that is located at the second end 14 of tool 10.

As also shown in FIGS. 1 and 2, splines 25 have a spiral shape and extend substantially throughout portion 46 of tool 10. As previously explained, splines 25 are defined by a crest 26 and roots 28, 30 that are disposed on opposite sides of crest 26. At any given position along longitudinal center axis 15, the radial position of roots 28, 30 from the longitudinal center axis are greater than the radial position of the crest 26.

The depth D1 of spline 25 is defined as the difference between R1, the radial position of crest 28, and R2, the radial position of roots 28 and 30, at a given location on the longitudinal center axis 15. In accordance with the presently disclosed invention, the depth D1 of the spline 25 is substantially constant at all longitudinal positions of the spline between minor end 56 and major end 58.

For each spline 25, crest 26 cooperates with each of roots 28, 30 to define sides 50 and 52 respectively at a given longitudinal position defined by a plane that is orthgonal to the longitudinal center axis 15, each of sides 50 and 52 define an internal included angle between the bisector of the internal included angle and either side 50 or 52 defines the relief angle £ of the spline at that longitudinal position. As shown in FIGS. 1 and 2, the relief angle £ for each of splines 25 progressively increases in the longitudinal positions direction toward the minor end 56 of hexagonal frustum 54. Conversely, the relief angle £ for each of splines 25 progressively decreases in the longitudinal direction toward the major end 58 of hexagonal frustum 54.

Viewed from the end 14 of tool 10, each of spines 25 have a generally triangular cross-section wherein sides 50 and 52 converge to form an apical edge or crest 26. Adjacent hexagonal sides 23 are joined by corners 60. Each of hexagonal sides 23 also has a respective midpoint 62 that is located midway between the corners 60 that are on opposite ends of a hexagonal side 23. The radial position of said splines 25 with respect to the longitudinal center axis 15 decreases the angular position of the crest 26 of said spline approaches the angular position of the midpoint 62 of the hexagonal side 23. In this way, even though the depth of each of the splines 25 is substantially the same, the splines that are closest to the respective midpoints 62 of hexagonal sides 23 are located at a shorter radial distance from the longitudinal center axis 15 than splines 25 that are located further away from the respective midpoints 62 of hexagonal sides 23.

In the use of tool 10, the tool is placed over a fastener that is to be removed from the associated threaded member. The tool 10 is positioned on the fastener such that the second end 14 of tool 10 passes over the outside perimeter of the fastener and splines 25 in the hexagonal frustum 54 of portion 46 engage the fastener.

Surprisingly, it has been found that the hexagonal shape of inside surface 40 of portion 46 affords improved operation of the disclosed tool in comparison to other tools known in the prior art. The splines 25 that are closest to the midpoint 62 of the hexagonal sides 23 engage the fastener while the splines 25 that are located away from midpoint 62 of the hexagonal sides 23 are held away from the fastener. That is because the midpoint 62 of the hexagonal sides is at a shorter radius from the longitudinal center axis 15 of the tool 10 than the corners 60, the splines 25 that are closest to the midpoint 62 engage the fastener before the splines that are located closer to corners 60.

When torque is applied to the tool 10 through a ratchet or other lever (not shown) that is inserted into portion 44 of the inside surface 40 this arrangement provides for transfer of the torque to the fastener through less than all of the splines 25. This causes the splines 25 that engage the fastener to bite into the fastener more deeply than arrangements wherein all of the splines initially engage the fastener. It has been found that this arrangement results in deeper engagement of the splines into the fastener and allows greater torque to be applied to the fastener.

Also in accordance with the invention disclosed herein is a preferred method for making tool 10 according to a cold forming process for tool manufacture. The presently disclosed method is practiced on a multi-station cold forming machine such as any of the types that are commercially available wherein the part is formed by sequentially passing the part through a plurality of forming stations. In the preferred embodiment, the stations are arranged in a linear array so that the part is processed at each station and then passed to the next station for further forming.

Cold forming machines such as described above are known to those skilled in the art who are familiar with the basic set up and operation thereof. The presently disclosed method is specifically directed to the particular arrangement of the process steps disclosed herein. The process is further described in connection with FIGS. 3A–3F and 4A–4F which show progressive changes in the part as it passes through the cold forming steps.

As shown in FIGS. 3 and 4, each of forming stations 3A through 3F comprise a cold forming station that has a punch assembly and a die assembly. As known to those skilled in the art, the commercially available cold forming machine has mechanisms for closing the punch assembly against the die assembly in coordination with the transfer of the partially finished part between stations.

Figure 3A:
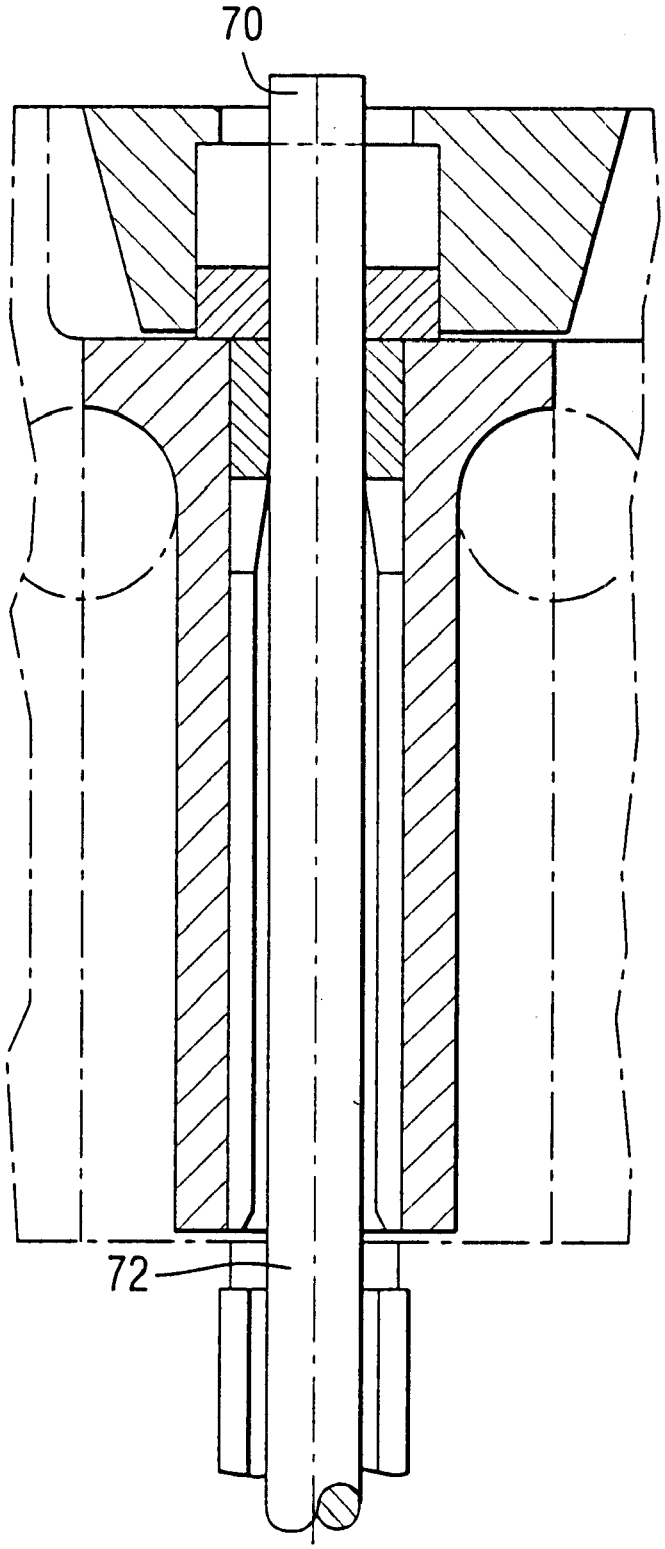
FIGS. 3A–3F is a layout drawing showing the tooling that is used in accordance with a presently preferred method of making the tool that is shown in FIGS. 1 and 2 herein.
Figure 3B:
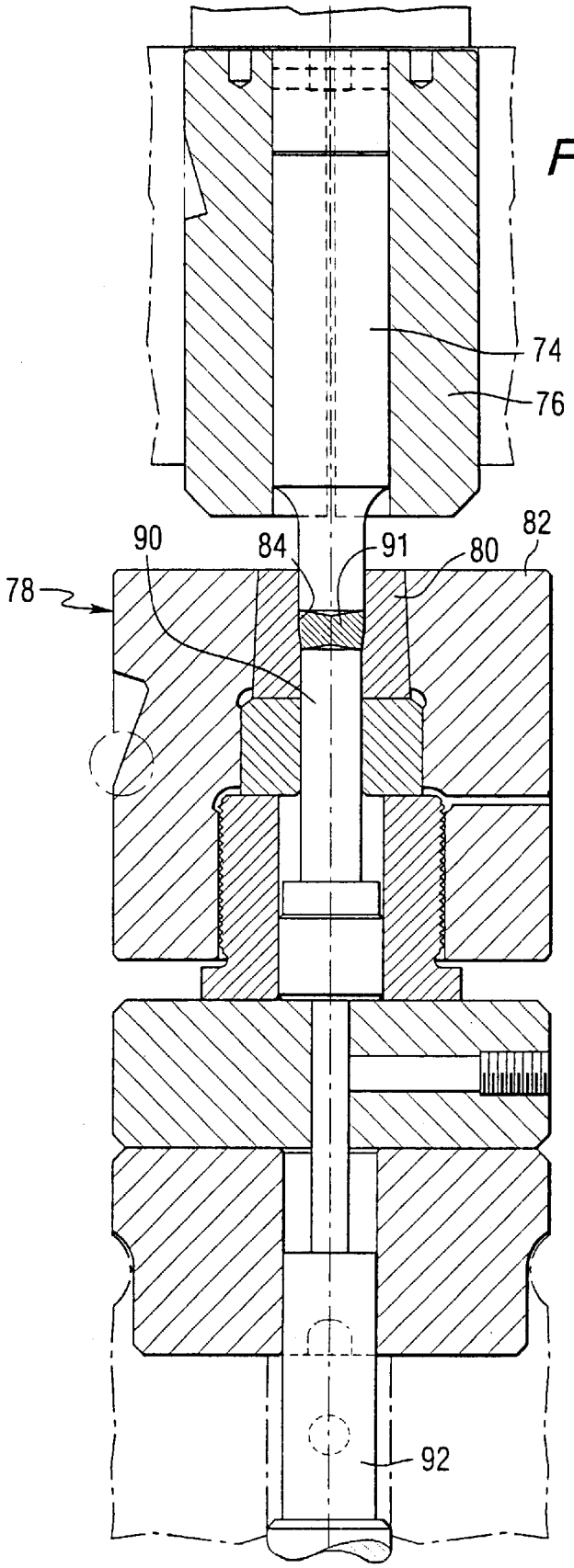
Figure 3C:
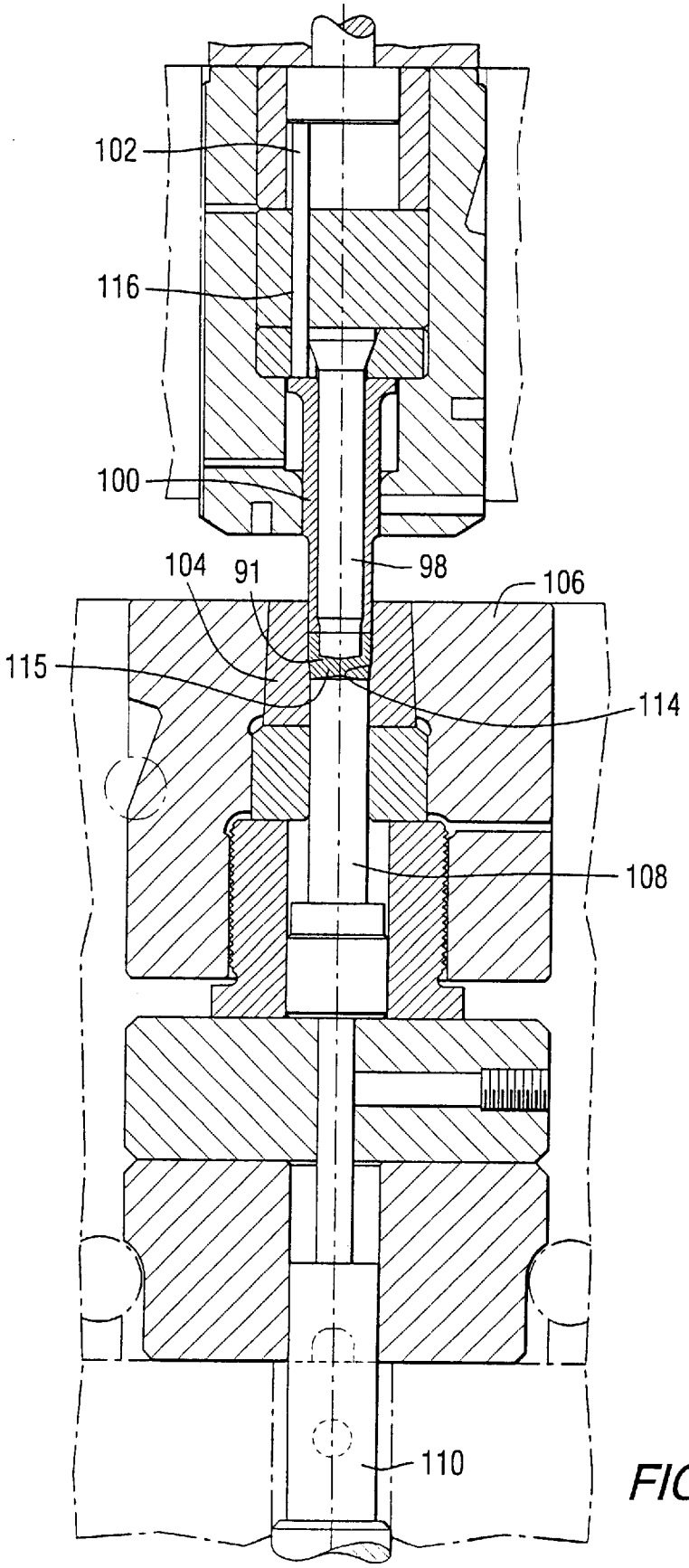
Figure 3D:
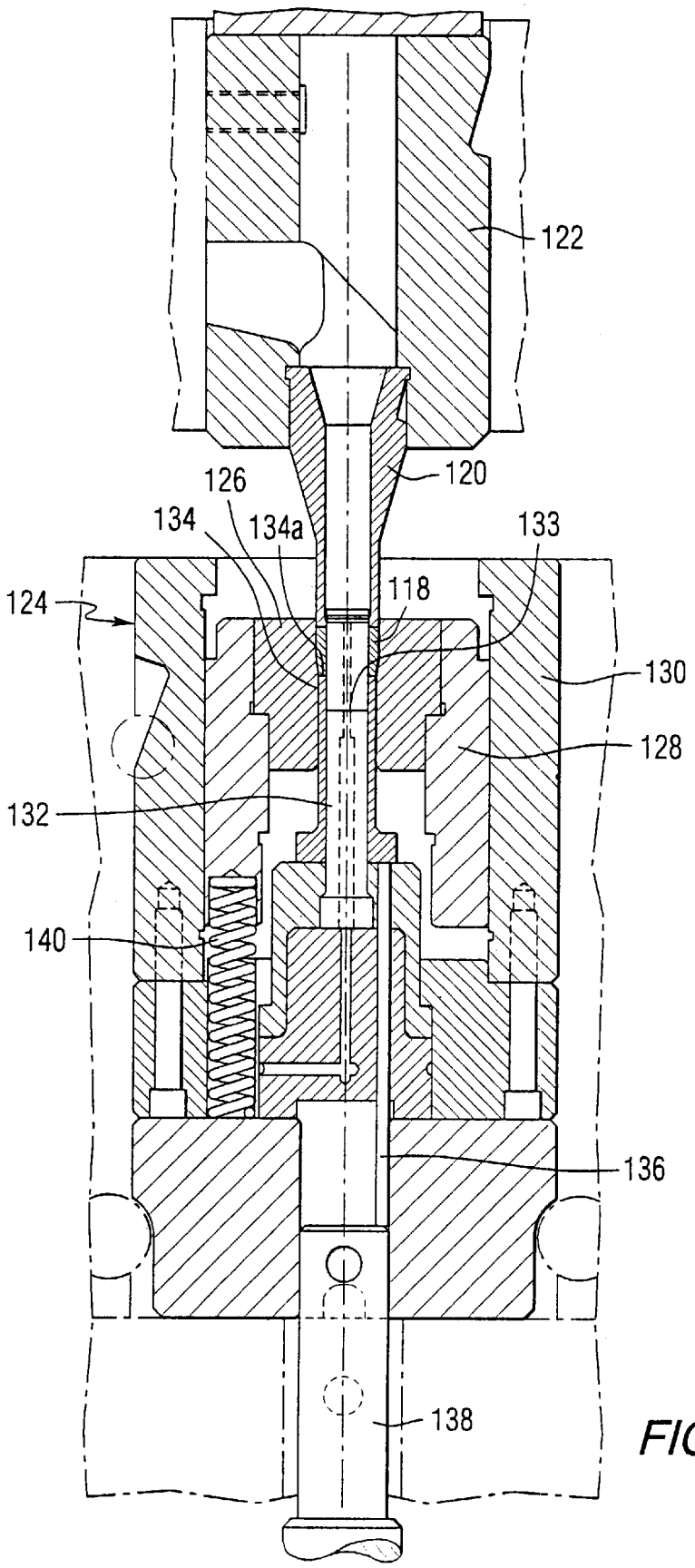
Figure 3E:
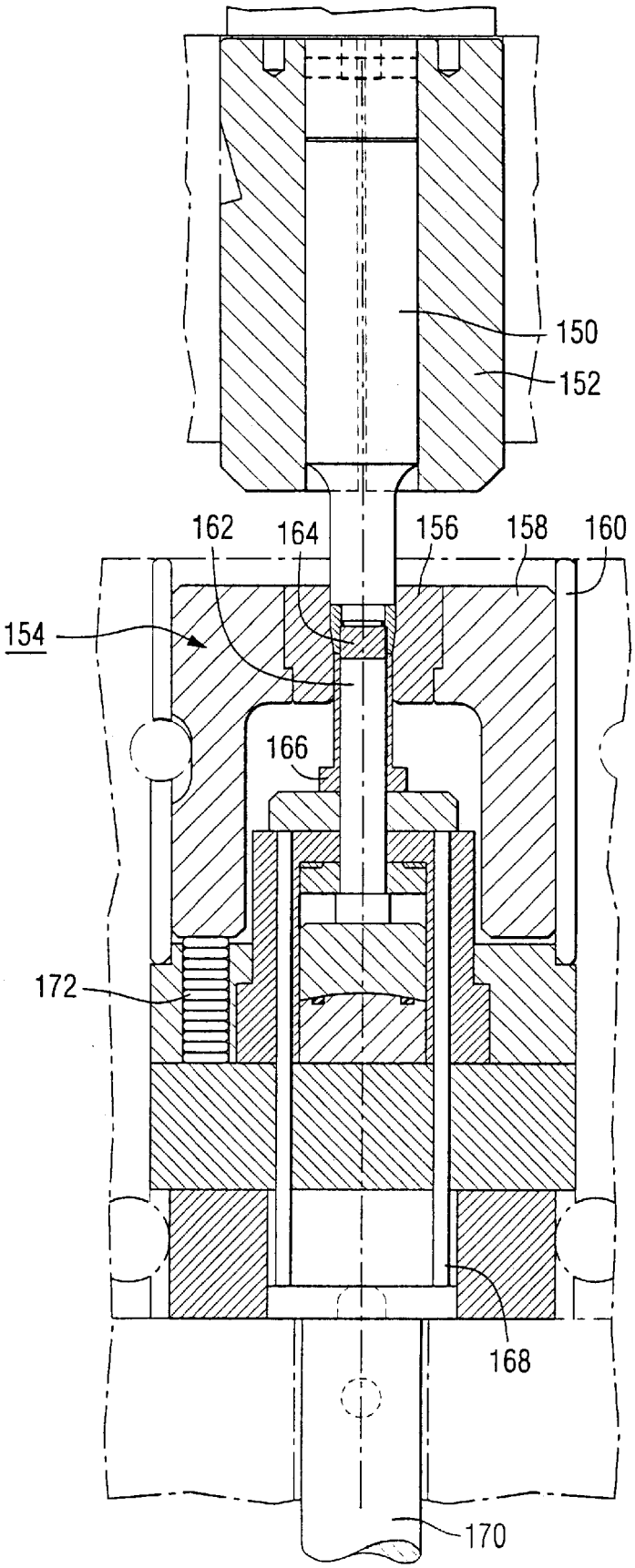
Figure 3F:
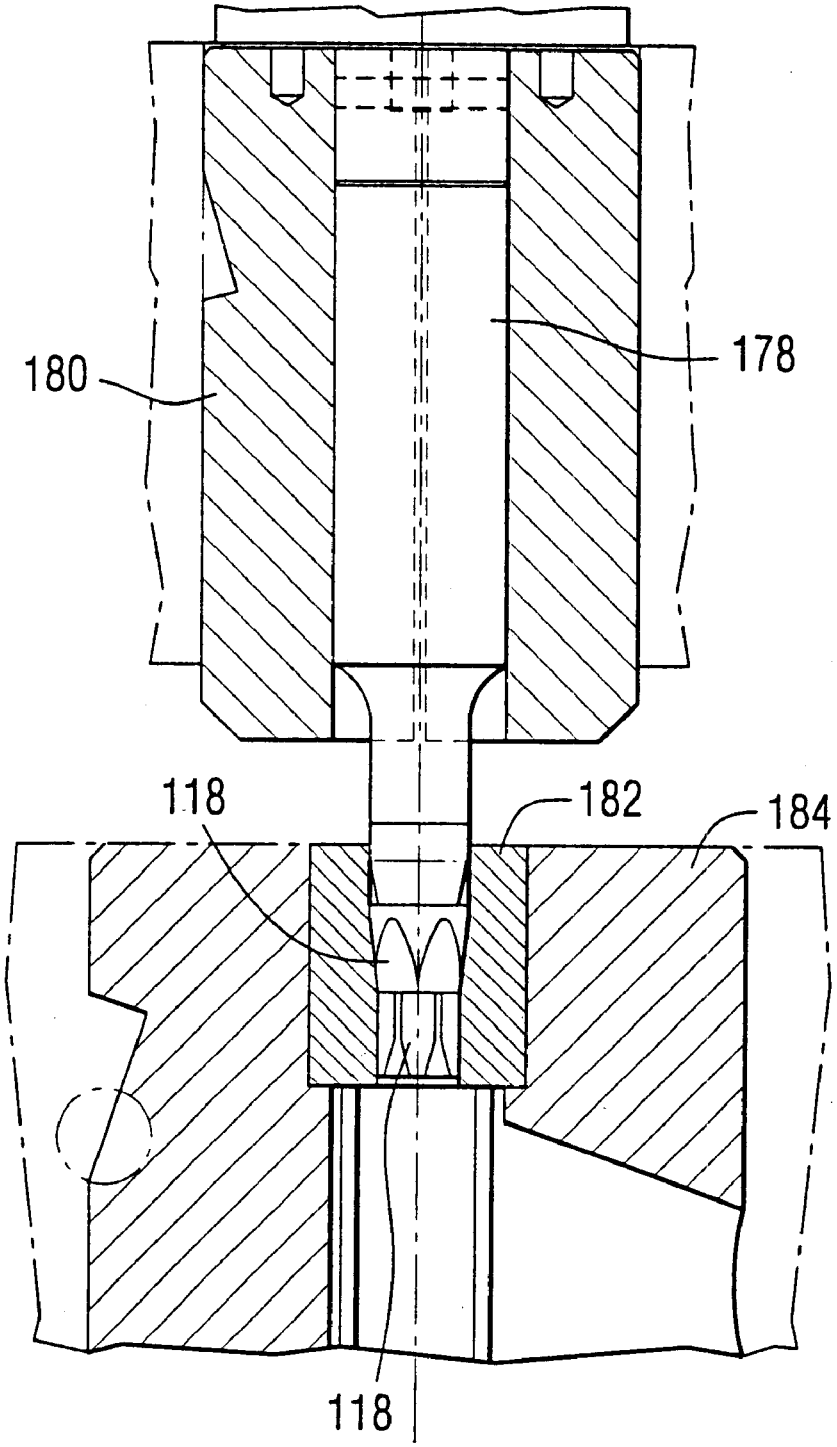
Figure 4C:
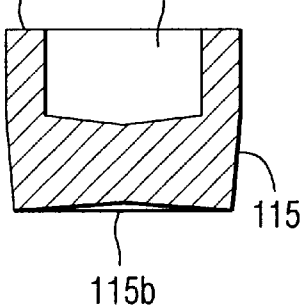
FIGS. 4A–4F are cross-sections of the tool as it is formed in the stations of the cold forming machine that is illustrated in FIGS. 3*A*–3F respectively.
Figure 4B:
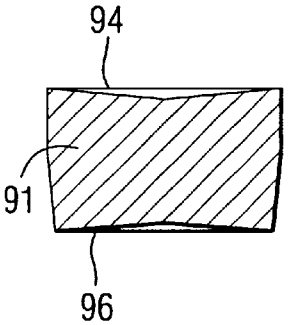
Figure 4A:
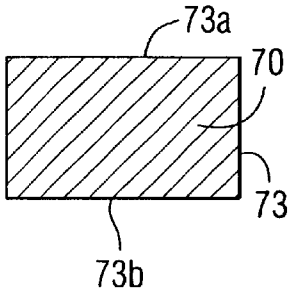
Figure 4E:
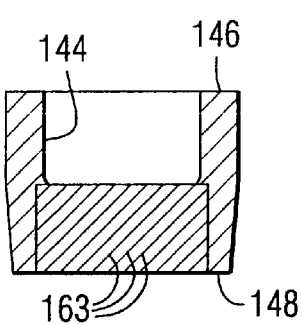
Figure 4D:
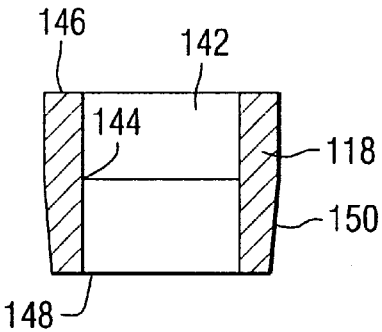
Figure 4F:
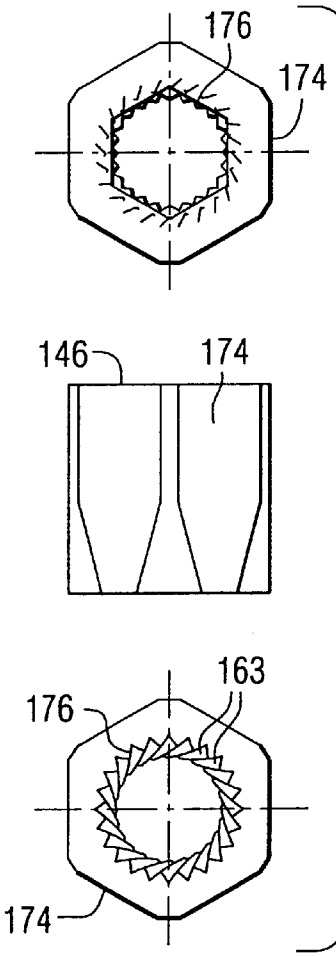

As illustrated in FIGS. 3A and 4A, station A is a station wherein a solid blank 70 is cut from a wire line 72. Blank 70 has a cylindrical surface 73 that is defined between a first end 73*a* and a second end 73*b*.

At station B, the punch assembly includes a punch 74 that is mounted in a tool case 76. Also at station B, the die assembly includes a die 78 that includes a die insert 80 that is mounted in a die case 82. The blank 70 is located in the die insert 80 which defines a tapered internal passageway 84. Punch 74 strikes the first end 73*a* of blank 70 while the second end 73*b* of blank 70 is opposed by a kick-out pin 90. This causes the outer surface of blank 70 to become tapered in accordance with the shape of passageway 84 of die insert 80. Thus, tapered blank 91 is formed. Tapered blank 91 has a first end 94 and a second end 96. The area of first end 94 of the tapered blank 91 is larger than the area of second end 96. Thereafter, kick-out pin 90 is actuated by kick-out rod 92 to remove the tapered blank 91 from die insert 80.

Tapered blank 91 is transferred to station C wherein the punch assembly is provided with an extrusion punch 98 that is concentrically mounted inside a stripper sleeve 100. The extrusion punch 98 is actuated by the punch assembly and the stripper sleeve 100 is longitudinally actuated with respect to punch 98 by an intermediate kick-out pin 102.

At station C, the tapered blank 91 from station B is positioned in a die that includes a die insert 104 that is mounted in a die case 106. The extrusion punch 98 strikes the first end 94 of the tapered blank 91 while the second end 96 of the tapered blank 91 is opposed by a kick-out pin 108 that is longitudinally actuated by a kick-out rod 110. This forms a well 112 to be formed in tapered blank 91 by extruding material of tapered blank 91 between the perimeter of the extrusion punch 98 and the inside wall 114 of the die insert 104. Tapered blank 91 thus becomes a well blank 115, is then removed from die insert 104 by the longitudinal action of the kick-out pin 108 and the kick-out rod 110. Well blank 115 is removed from the end of the extrusion punch 98 by the longitudinal extension of an intermediate pin 116 that cooperates with the stripper sleeve 100. Intermediate pin 116 forces stripper sleeve 100 longitudinally with respect to extrusion punch 98 so that stripper sleeve 100 contacts the first end 115*a* of well blank 115 around the perimeter of the well 112 formed therein and strips tapered blank 91.

Well blank 115 with well 112 is removed from station C and transferred to station D where it is formed into a tubular section 118. At station D, the punch assembly includes hollow punch 120 that is mounted in a tool case 122. Well blank 115 is placed in a die 124 that includes a die insert 126 that is mounted in a sliding die case 128. Sliding die case 128 is mounted in a sliding die sleeve 130 such that die sleeve 130 is secured to the die plate at the die assembly and sliding die case 128 is moveable with respect to die sleeve 130 in the direction of the longitudinal axis of hollow punch 120.

The die assembly at station D further includes a pierce punch 132. The end area 133 of pierce punch 132 substantially corresponds to the cross-section of the bottom of well 112 in well blank 115. Pierce punch 132 is mounted to the die plate and is oriented in alignment with the longitudinal direction of hollow punch 120. A cylindrical kick-out sleeve 134 is concentrically arranged around pierce punch 132 with kick-out sleeve 134 being actuated with respect to pierce punch 132 in the longitudinal direction by an intermediate kick-out pin 136 and a kick-out rod 138.

Sliding die case 128 and die insert 126 are mechanically biased by a spring 140 to the end of the travel within die sleeve 130 that is remote from the die assembly. Tapered blank 91 is mounted in die insert 126 while the die insert 126 is biased against the limit of travel within die sleeve 130 that is away from,pierce punch 132. The first end 115*a* of well blank 115 is then contacted by hollow punch 120 and hollow punch 120 presses against the first end 115*a* of well blank 115. Hollow punch 120 overcomes the bias force of spring 140 and moves the die insert 126 and well blank 115 toward the end 133 of pierce punch 132.

As hollow punch 120 continues to move well blank 115 along the line of travel within die sleeve 130, the second end 115*b* of well blank 115 contacts the end 134*a* of the cylindrical kick-out sleeve 134. As hollow punch 120 moves further, the end 133 of pierce punch 132 contacts the second end 115*b* of well blank 115. As well blank 115 continues to move longitudinally, the end 133 of the pierce punch is received in the hollow punch 120 and pierce punch 132 punches out a portion of the second end 115*b* of well blank 115 that corresponds to the area of the bottom of the well 112.

The portion of the second end 115*b* that is cleared is opposite from the bottom of the well 112 such that the pierce punch 132 opens a center bore 142 in the direction of the longitudinal axis of the well blank 115 to form the tubular section 118. Tubular section 118 has an inner cylindrical surface 144 between a first end 146 and a second end 148. Tubular section 118 further includes an outer surface 150 between first end 146 and second end 148. At least a portion of outer surface 150 is tapered such that for a portion of tubular section 118 that is adjacent second end 148, the radial dimension or wall thickness between inner cylindrical surface 144 and outer surface 150 increases as the longitudinal position away from the second end 148 of tubular section 118 increases.

Next, hollow punch 120 is retracted to its initial position and kick-out sleeve 134 is longitudinally actuated by kick-out rod 138 to force the end of the kick-out sleeve against the second end 148 of the tubular section to remove the tubular section from the pierce punch 132 and die insert 126.

Tubular section 118 is then removed from station D, and transferred to station E where it is provided with a plurality of spiral splines that are formed in the inner surface 144. At station E, the punch assembly includes a punch 150 that is mounted in a tool case 152. Tubular section 118 is placed in a die 154 that includes a die insert 156 that is mounted in a sliding die case 158. Sliding die case 158 is mounted in a sliding die sleeve 160 that is secured to the die plate. Sliding case 158 is moveable with respect to die sleeve 160 in the direction of the longitudinal axis of punch 150.

The die assembly at station E further includes a spline punch 162 that has an end with a plurality of spiral splines 164. Spline punch 162 has a substantially constant radius. along the length thereof and is mounted to the die plate such that it is oriented in alignment with the longitudinal direction of punch 150. A cylindrical kick-out sleeve 166 is concentrically arranged around spline punch 162 with kick-out sleeve 166 being actuated in the longitudinal direction by an intermediate kick-out pin 168 and a kick-out rod 170.

Sliding die case 158 and die insert 156 are mechanically biased by a spring 172 to the end of the travel within die sleeve 160 that is remote from the spline punch 162. Tubular section 118 is mounted in die insert 156 while the die insert 156 is biased against the limit of travel within die sleeve 160 that is away from spline punch 162. The first end 146 of tubular section 118 is then contacted by the punch 150 and punch 150 presses against the first end 146 of tubular section 118. Punch 150 overcomes the bias force of spring 172 and moves the die insert 156 and tubular section 118 toward the end of the spline punch 162.

As the punch 150 continues to move tubular section 118 along the length of travel within die sleeve 160, the second end 148 of tubular section 118 contacts the end of the cylindrical kick-out sleeve 166. Next, the end of spline punch 162 contacts the second end 148 of the tubular section 118. As tubular section 118 continues to move longitudinally, the splined end of the spline punch 162 is received in the bore 142 and the spline punch 162 forms spiral splines 163 in the portion of the inner surface 144 of tubular section 118 that is adjacent second end 148. Spline punch 162 is mounted on the die assembly in a floating manner such that spline punch 162 rotates freely in the angular direction. As spline punch 162 is driven into bore 142, spline punch 162 freely rotates in accordance with the direction of the spiral of the splines 164.

When punch 162 has formed splines 163 on inner surface 144, punch 150 is retracted to its initial position and kick-out sleeve 166 is longitudinally actuated by kick-out pin 168 and kick-out rod 170 to force the end of the kick-out sleeve against the second end 148 of the tubular section and remove the tubular section from the spline punch 162 and die insert 156. Upon removal of the tubular section 118, the spline punch 162 rotated in the opposite angular direction from the rotation when the spline punch 162 is driven into bore 142.

At station F, the tubular section 118 has spiral splines 163 in one end of the internal surface 144. At station F, the tubular section 118 is formed to provide a hexagonal outer surface 174 and a hexagonal inner surface 176. A punch 178 is secured in a tool case 180. The tubular section 118 is placed in a round-to-hexagonal extrusion insert 182 that is mounted in a die case 184. Die case 184 is mounted to the die plate.

After tubular section 118 is transferred to extrusion insert 182, punch 178 contacts first end 146 of tubular section 118 to force tubular section 118 through extrusion insert 182. The movement of tubular section 118 through extrusion insert 182 forms the tapered outer surface 150 of tubular section 118 to a surface 184 that is a hexagonal surface. That is, in a cross-section of tubular section 118 that is orthogonal to longitudinal center axis 15, surface 184 defines a hexagonal shape. The shape of outer surface 150 is substantially constant throughout the length of tubular insert 118. At the same time, the extrusion forms the cylindrical inner surface 144 of the tubular section into a hexagonal inner surface. That is, in a cross-section of tubular section 118 that is orthogonal to longitudinal center axis 15, surface 144 defines a hexagonal shape. The shape of inner surface 144 is tapered throughout the longitudinal length of the position of the tubular insert 118 that is adjacent to the second end of the tubular insert such that radial dimension or well thickness between inner surfaces 144 and outer surface 150 increases as the longitudinal position away from the second end of the section increases. The shape of inner surface 144 is substantially constant throughout the length of the section. However, the area enclosed by surface 144 progressively decreases and the hexagonal sides also decrease as the longitudinal position away from the second end of the section increases. Splines 163 in the portion of the insert that is adjacent to the second end are spiraled and otherwise arranged as previously described herein with respect to tool 10.

After the cold-forming steps described in connection with FIGS. 3A–3F of 4A–4F have been completed, the outer surface of the section is machined and finished to provide the outer surface of the portion of the tool that is adjacent to the first end with a round surface. The outer surface can also be finished with conventional finishing processes as well known and understood by those skilled in the relevant art.

While a presently preferred embodiment of the disclosed tool, together with a presently preferred method for making the same, have been disclosed herein, the scope of the disclosed invention is not limited thereto, but can otherwise be variously embodied within the scope of the following claims.

What is claimed is:

1. A process for making a tool for removing fasteners wherein the tool is cold formed from a tubular section that has a cylindrical inside surface and a tapered outside surface, said process comprising:

driving the tubular section onto a floating punch that has helical splines at one end, said floating punch rotating in a first direction as it is driven into the tubular section to form helical splines in one end of the cylindrical inner surface of the tubular section;

stripping the tubular section off of the end of the floating punch, said floating punch rotating in the opposite direction from the first direction as the tubular section is stripped off of the floating punch; and extruding the tubular section through a round-to-polygonal extrusion die insert to cold form the tapered outer surface of the tubular section to a polygonal surface having a substantially constant cross-section, said extruding step also cold forming the cylindrical inner surface of the tubular section to a tapered, polygonal surface to provide a section having a tapered, polygonal, inner surface that includes a plurality of spiral splines.

2. The process of claim 1 wherein the tubular section is driven onto a floating punch that has helical splines that are located at a substantially constant radius from the longitudinal center axis of the floating punch.

3. The process of claim 2 wherein said step driving the floating punch into the second end of the tubular section comprises the further steps of:

positioning the tubular section in a die insert that is moveable with respect to the floating punch, said die insert being movable in the direction of the longitudinal axis of the floating punch;

punching the first end of the tubular section with a punch to move the tubular section toward the floating punch and then drive a portion of the tubular section over the splines of the floating punch to form splines on the internal surface of the tubular section; and moving a cylindrical kickout sleeve that fits concentrically around the floating punch, and that is slidable with respect to said floating punch, said kick-out sleeve being moved in the direction of the longitudinal axis of said floating punch while the kickout sleeve opposes the second end of the tubular section to strip the tubular section off of the floating punch.

4. A process for cold forming a tool for removing fasteners, said tool being cold formed from a tubular section that has a first end and a second end with an open passageway between the first and second ends, said tubular section defining a cylindrical inside surface between said first and second ends, said tubular section also defining a tapered outside surface that has an increasing diameter at longitudinal positions on the tubular section that are increasingly apart from the second end of the tubular section, said cold forming process comprising:

driving a punch against the first end of the tubular section to place the tubular section into a die insert that is mounted in a die sleeve, said die insert being moveable with respect to said die sleeve in the direction of the longitudinal axis of the tubular section, the second end of said tubular section being driven onto a floating punch having helical splines that are located at the distal end thereof, said floating punch rotating in a first direction as the tubular section is driven onto the floating punch and the splines form complementary internal splines on the cylindrical inner surface of the tubular section;

stripping the tubular section off of the floating punch by pushing against the second end of the tubular section with a stripper sleeve, said floating punch counter-rotating as the stripper sleeve presses on the second end of the tubular section and the tubular section travels to the end of the spline punch;

extruding the tubular section through a round-to-polygonal extrusion die insert, said extruding step cold forming the tapered outer wall of the tubular section into a polygonal surface having substantially constant cross-section at longitudinal positions of the insert, said extruding step also cold forming the inside surface of the tubular section into a polygonal surface corresponding to the shape of the outside surface and that is tapered to provide a decreasing cross-section at longitudinal positions in the direction from the second end of the tubular section toward the first end of the tubular section to provide an inside surface having a tapered, polygonal shape with helical splines in the end of said inside surface that is adjacent the second end.

5. The process of claim 4 wherein a straight splined punch is pressed into the tubular section.

6. The process of claim 5 wherein said step of driving the floating punch into the second end of the tubular section comprises the steps of:

positioning the tubular section in a die insert, said die insert being slidably mounted in a die sleeve and being biased toward one end of said die sleeve;

opposing the second end of the tubular section with a cylindrical kickout sleeve that fits concentrically around the floating punch and that is slidable in a longitudinal direction with respect to said floating punch;

pressing against the first end of the tubular section with a punch, said punch overcoming the bias force of the die insert in said die sleeve, said punch also driving one end of the tubular section over the splined end of the floating punch to cause the floating punch to form internal splines on the inner surface of the tubular section;

retracting the punch so that the bias spring urges the die insert away from the end of the floating punch; and pressing against the second end of the tubular section with a kickout sleeve to strip the tubular section off the end of the floating punch while the floating punch rotates in the direction that is opposite from the first direction so that the die insert returns to its starting position.

7. A process for cold forming a tool for removing a fastener, said tool being cold formed from a cutoff blank that is cut from a wire line, said process comprising:

hitting the cutoff blank to square up the blank and to form a tapered outside surface for the blank;

punching the tapered blank with an extrusion punch to form an extruded, tapered blank having a well in the cutoff blank by extruding metal in the cutoff blank in the direction past the extrusion punch, said well being on the same side of the cutoff blank as the extrusion punch;

urging a hollow punch against the first end of the extruded, tapered blank to maintain the extruded, tapered blank in a die insert, that is slidably mounted in a die sleeve and mechanically biased toward one end of the die sleeve, said hollow punch urging the blank into the die insert and pushing the extruded tapered blank against a pierce punch, a second end of said extruded, tapered blank that is located oppositely from the bottom of the well in said extruded, tapered blank being pressed against the end of the pierce punch to pierce the second end of the extruded, tapered blank to form a tubular section with a tapered outside surface and a cylindrical inside surface;

pushing on the first end of the tubular section when the tubular section is mounted in a die insert, that is slidably mounted in a die sleeve and mechanically biased toward one end of the die sleeve, said pushing step moving the tubular section away from the one end of the die sleeve and onto a floating punch that has helical splines at the end thereof, said floating punch rotating in a first direction and said helical splines interfering with the inside surface of the tubular section and forming internal helical splines in a portion of the inside surface of the tubular section adjacent the second end of the tubular section;

relieving the force against the first end of the tubular section that opposes the bias force against the die insert;

urging a kickout sleeve against the second end of the tubular section to strip the tubular section off of the splined end of the floating punch while the floating punch rotates in the direction that is the opposite direction from the first direction of rotation; and extruding the tubular section through a round-to-hexagonal extrusion die so that the tapered, round outer surface of the tubular section is cold formed to a hexagonal cross-section having substantially constant dimensions at position along the longitudinal axis of the tubular section, and also so that the inside surface of the tubular section is cold formed from a cylindrical surface to a surface that has a hexagonal cross-section with smaller dimensions at longitudinal positions away from the second end of the tubular section, the inner surface also having spiral-shaped splines in a portion of the inner surface that is adjacent to the second end of the tubular section.

8. The process of claim 7 wherein the floating punch is a constant radius splined punch.

9. A process for making a tool to remove damaged fasteners from threaded members, said tool being made in a cold forming machine having a plurality of forming stations that are arranged in a linear array, said cold forming machine having a punch assembly and a die assembly that correspond to each of said forming stations, said process comprising the steps of:

cutting a solid blank from a wire line, said blank having a cylindrical surface that is defined between a first end and a second end;

placing the blank in a punch die that defines a tapered surface and striking the first end of the blank with a punch to provide a tapered blank that has a round, tapered outer surface that is defined between a first end and a second end wherein the second end has a smaller cross-section than the first end;

hitting the first end of the tapered blank with an extrusion punch and while the tapered blank is maintained in a die, said hitting step forming an extruded, tapered blank having a well therein by causing material of the tapered blank to be extruded between the perimeter of the extrusion punch and the die wall;

piercing the extruded, tapered blank with a pierce punch, said pierce punch having an end cross-section that substantially corresponds to the area of the bottom of the well in the extruded, tapered blank, said pierce punch traveling through the second wall of the extruded, tapered blank at a position that is opposite from the bottom of the well, said pierce punch opening a center bore in the extruded, tapered blank in the direction of the longitudinal axis of the extruded, tapered blank to provide a tubular section having a cylindrical internal surface between first and second end surfaces and also having a tapered outer surface between the first and second end surfaces;

driving a spline extrusion punch having a substantially constant radius into the bore of the tubular section from the second end of the tubular section to form internal splines on a portion of the inner surface of the tubular section that is adjacent the tapered end of said tubular section; and extruding the splined, tubular section through a round-to-polygonal extrusion insert to form a constant dimensioned outside wall for the tubular section and to form a polygonal inside wall having a tapered dimension and spiral-formed splines at the wide end of the inner surface of the tubular section.

10. The method of claim 9 wherein said piercing step comprises the further steps of;

mounting the extruded, tapered blank in a die that is secured to a die sleeve, said die being slidable with respect to said die sleeve and with respect to said pierce punch in the direction of the longitudinal axis of the pierce punch;

opposing the second end of the extruded, tapered blank with a cylindrical kickout sleeve that fits concentrically around the pierce punch and that is slidable in a longitudinal direction with respect to said pierce punch; and pressing against the first end of the extruded, tapered blank with a hollow punch having an internal bore that is sized to receive the pierce punch through the end of the hollow punch, said hollow punch moving the extruded, tapered blank toward pierce punch and then driving the extruded, tapered blank onto the pierce punch to cause the pierce punch to clear the center portion of the second end of the extruded, tapered blank to form a tubular section having a tapered outer surface and a cylindrical inner surface.

11. The process of claim 9 wherein said step of driving the floating punch into the second end of the tubular section comprises the steps of:

positioning the tubular section in a die, said die being slidably mounted in a die sleeve such that said die is movable with respect to said die sleeve in the longitudinal direction of the floating punch, said die being biased toward one end of said die sleeve;

opposing the second end of the tubular section with a cylindrical kickout. sleeve that fits concentrically around the floating punch, said kickout sleeve being slidable in a longitudinal direction with respect to said floating punch;

extending a punch against the first end of the tubular section, said punch moving the tubular section against the bias force of the die, said punch also driving the floating punch into the center bore of the tubular section as the floating punch is allowed to rotate in a first direction to form spiral-shaped splines on the internal surface of the tubular section; and retracting the punch and pressing on the second end of the tubular section as the floating punch is allowed to rotate in a direction that is opposite to the first direction to strip the tubular section off of the end of the floating punch and return the die to its bias position at one end of the die sleeve.

* * * * *